US005152206A

United States Patent [19]

Mulling

[11] Patent Number: 5,152,206

[45] Date of Patent: Oct. 6, 1992

[54] VINYL TRIM SALVAGE MACHINE

[75] Inventor: John I. Mulling, Midville, Ga.

[73] Assignee: Midville Tool & Die Co., Inc., Midville, Ga.

[21] Appl. No.: 554,396

[22] Filed: Jul. 19, 1990

[51] Int. Cl.[5] ..... B26D 1/22; B26D 7/06

[52] U.S. Cl. ..... 83/425.3; 83/430; 83/436; 83/444; 83/449

[58] Field of Search ..... 83/425.3, 425.4, 430, 83/434, 436, 444, 448, 500, 544, 508.3, 676, 425.2, 425, 449, 545

[56] References Cited

U.S. PATENT DOCUMENTS

| | | | |
|---|---|---|---|
| 180,373 | 7/1876 | Reese | 83/449 |
| 461,747 | 10/1891 | Fisher . | |
| 1,751,549 | 3/1930 | Hope et al. | 83/430 X |
| 1,822,209 | 9/1931 | Gammeter . | |
| 1,978,703 | 10/1934 | Ehlers | 83/430 |
| 2,456,866 | 12/1948 | Criner | 83/425.4 |
| 2,476,326 | 7/1949 | Sherman . | |
| 2,597,279 | 5/1952 | Bailey | 83/425.3 |
| 2,941,560 | 6/1960 | McCaffery . | |
| 3,120,777 | 2/1964 | Genin | 83/436 X |
| 3,656,382 | 4/1972 | Cyphers | 83/430 X |
| 3,742,796 | 7/1973 | McMillan | 83/425.4 X |
| 3,769,864 | 10/1973 | Morse | 83/79 |
| 3,788,180 | 1/1974 | Potsch et al. | 83/425.44 |
| 3,828,633 | 8/1974 | Klinger | 83/430 X |
| 3,982,455 | 9/1976 | Bowman | 83/430 X |
| 4,046,043 | 9/1977 | Kistner et al. | 83/430 X |
| 4,370,910 | 2/1983 | Suzuki | 83/876 |
| 4,846,032 | 7/1989 | Jampathom | 83/51 |

*Primary Examiner*—Frank T. Yost
*Assistant Examiner*—Eugenia A. Jones
*Attorney, Agent, or Firm*—Cushman, Darby & Cushman

[57] ABSTRACT

A vinyl trim salvage machine is provided for salvaging vinyl from defective or used vinyl trim for automobiles. The machine includes spaced cutting edges which are mounted for rotation relative to a vinyl trim guide channel so as to engage and move the vinyl trim therebelow while simultaneously severing longitudinal metal crimped edges from a central vinyl portion whereby the central vinyl portion can be reground and reused.

15 Claims, 6 Drawing Sheets

VINYL TRIM SALVAGE MACHINE

BACKGROUND AND SUMMARY OF THE INVENTION

The present invention relates to a machine for salvaging usable portions of used and/or defective materials and, in particular, to a machine for salvaging vinyl from used or defective vinyl automobile trim.

Reconditioning and reusing old parts and recycling portions of used and defective products have long been common practice to reduce the cost of materials and out of concern for the environment. When an entire product can be reconditioned and reused then recycling the same presents only minor problems. When, however, only a portion of the product can be reused or recycled then specialized machines and/or processes are generally required for recycling to be possible and economical.

The present invention is a machine for separating reusable, recyclable portions from a product which includes portions which cannot be easily processed for reuse.

Used or defective vinyl trim for automobiles is one such product. Indeed, such vinyl trim is typically formed from an elongated piece of vinyl 100 which has metal !02 crimped to each longitudinal side edge thereof so that from the front the trim has a vinyl central portion 104 and metal edges 106 (FIG. 1 and 2). The vinyl 100 used to form such trim 108 can be reground and used again. However, the metal crimping 102 provided along the longitudinal edges of the vinyl trim 108 presents an obstacle to such regrinding and reuse.

A further problem encountered when salvaging vinyl from vinyl trim is that vinyl trims for automobiles come in a variety of widths. Therefore, different pieces of trim have metal crimped edges of different widths and vinyl central portions of different widths. The present invention provides a machine which can advantageously separate the bulk of the vinyl, defined at the vinyl central portion 104, from the longitudinal metal crimped edges 106 so that the bulk of the vinyl can be reground and used again.

More particularly, the vinyl trim salvage machine provided in accordance with the present invention advantageously severs the vinyl trim 108 along its length between the vinyl central portion 104 and each of the longitudinal metal crimped edges 106 so as to advantageously salvage the bulk of the vinyl from such trim. Furthermore, varying vinyl trim types can be accommodated in accordance with the present invention by providing a plurality of cutting devices in a single machine for cutting the metal edges from trims having central portions of various widths.

Other objects, features, and characteristics of the present invention as well as the methods of operation and functions of the related elements of structure, and the combination of parts and economies of manufacture, will become more apparent upon consideration of the following description and the appended claims with reference to the accompanying drawings, all of which form a part of this specification, wherein like reference numerals designate corresponding parts in the various figures.

DETAILED DESCRIPTION OF THE PRESENTLY PREFERRED EXEMPLARY EMBODIMENT

Figure 1:
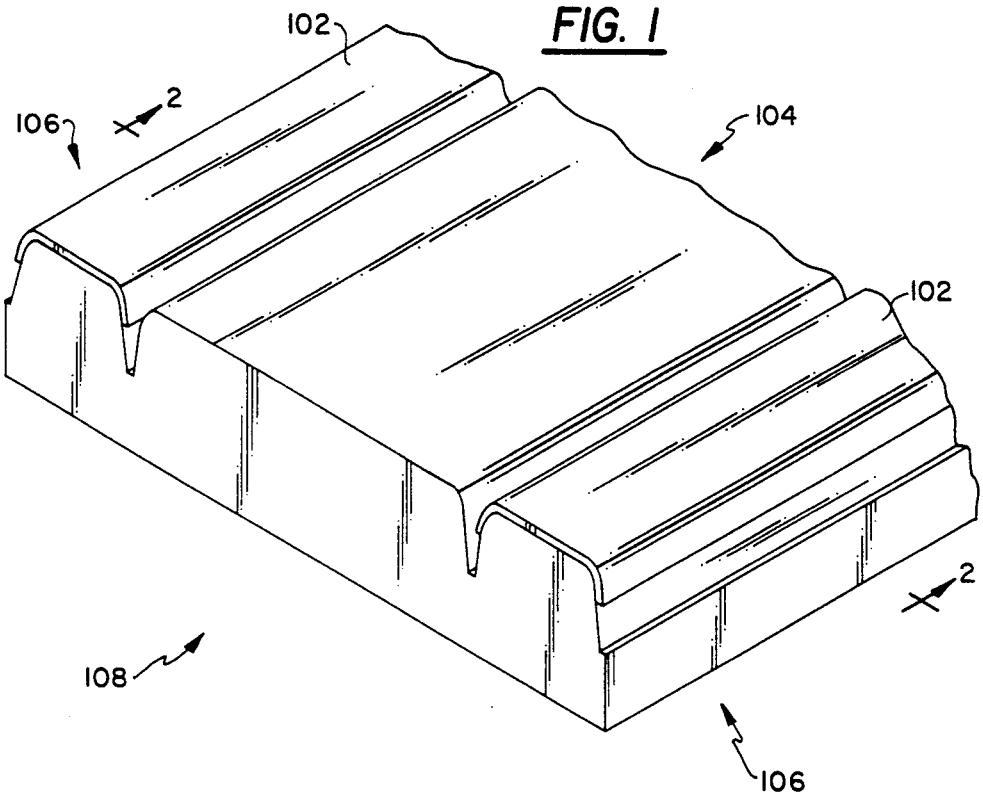
FIG. 1 is a perspective view of a piece of vinyl trim which can be processed in accordance with the present invention.
Figure 2:
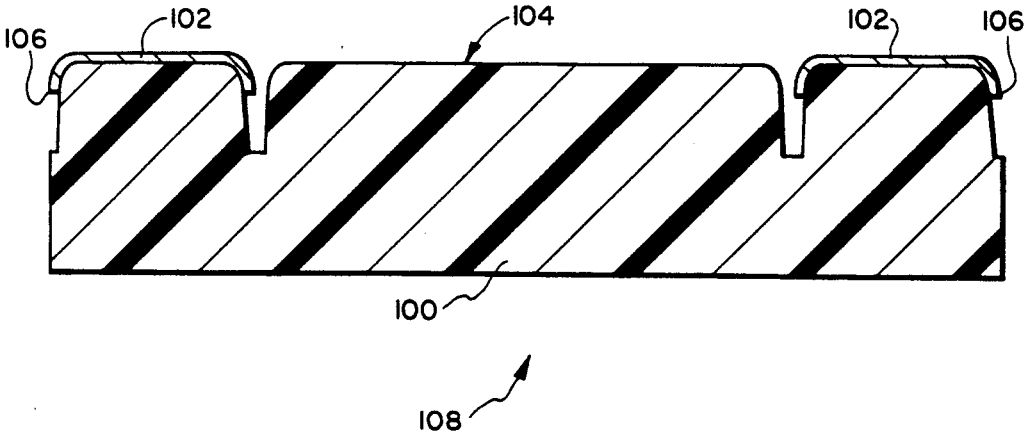
FIG. 2 is a cross-sectional view taken along line 2—2 of FIG. 1.

A vinyl trim salvage machine 10 provided in accordance with the present invention includes a base shown generally at 12 which is fixedly secured to a support structure 14. At least one vinyl trim receiving channel 16 is defined on the upper surface of the base 12. In the illustrated embodiment, three vinyl trim guide channels 16 are defined on the upper surface of the base 12 by, for example, mounting guide channel defining plates 18 to the upper surface of a substantially rectilinear base plate 20.

A cutter housing 22 including first and second side walls 24 is mounted to the base 12 and extends vertically upwardly therefrom. In the illustrated embodiment, the walls 24 are fixedly coupled to the side edges of the substantially rectilinear base plate 20. The side walls 24 of the cutter housing each have an aperture defined therethrough through which a bearing assembly 26 is disposed to rotatably mount a cutter shaft 28 with respect to the housing 22 and the base 12. The cutter housing 22 also preferably has a top wall 30 primarily for the purpose of protecting the operator from flying debris and contact with the blades 32 of the machine 10. The topwall 30 is preferably transparent, at least in part, to permit observation of the machine's operation.

A pair of cutting blades 32, for example scalloped cutting blades, are provided on shaft 28 for engaging and cutting a piece of vinyl trim fed through a vinyl trim guide channel 16, as discussed more fully below. Thus, in the illustrated embodiment, three pairs of circular blades 32 are mounted to and spaced along the cutter shaft, one pair for each guide channel !6. Each pair of blades 32 is spaced apart from a next adjacent pair of blades 32 by suitable spacers 34 which are fixedly mounted to the shaft 28 so as to rotate therewith. The spacers 34 maintain the blades 32 in predetermined spaced apart relation and maintain the pairs of blades at each longitudinal end of the functional portion of the shaft spaced from the bearing 26 through which the shaft 28 is rotatable mounted to the housing 22.

Spacers 36 are provided between the blades 32 of each pair. In the illustrated embodiment the blade spacers 36 have a radius greater than the radius of the spacers 34 mounted between adjacent pairs of blades 32 but less than the radius of the respective blades 32. (FIG. 5) Specifically, the blade spacers 36 are provided so as to have a radius such that, as vinyl trim is passed thereby, as discussed more fully below, the surface of the blade spacer 36 engages, grips and urges the vinyl trim 108 along the guide channel 16 under the blades 32. In order to provide such gripping action, in accordance with the preferred embodiment of the invention, the blade spacers 36 are provided with a knurled surface 38 which enables frictional engagement between that surface and the central vinyl trim portion 104.

Figure 5:
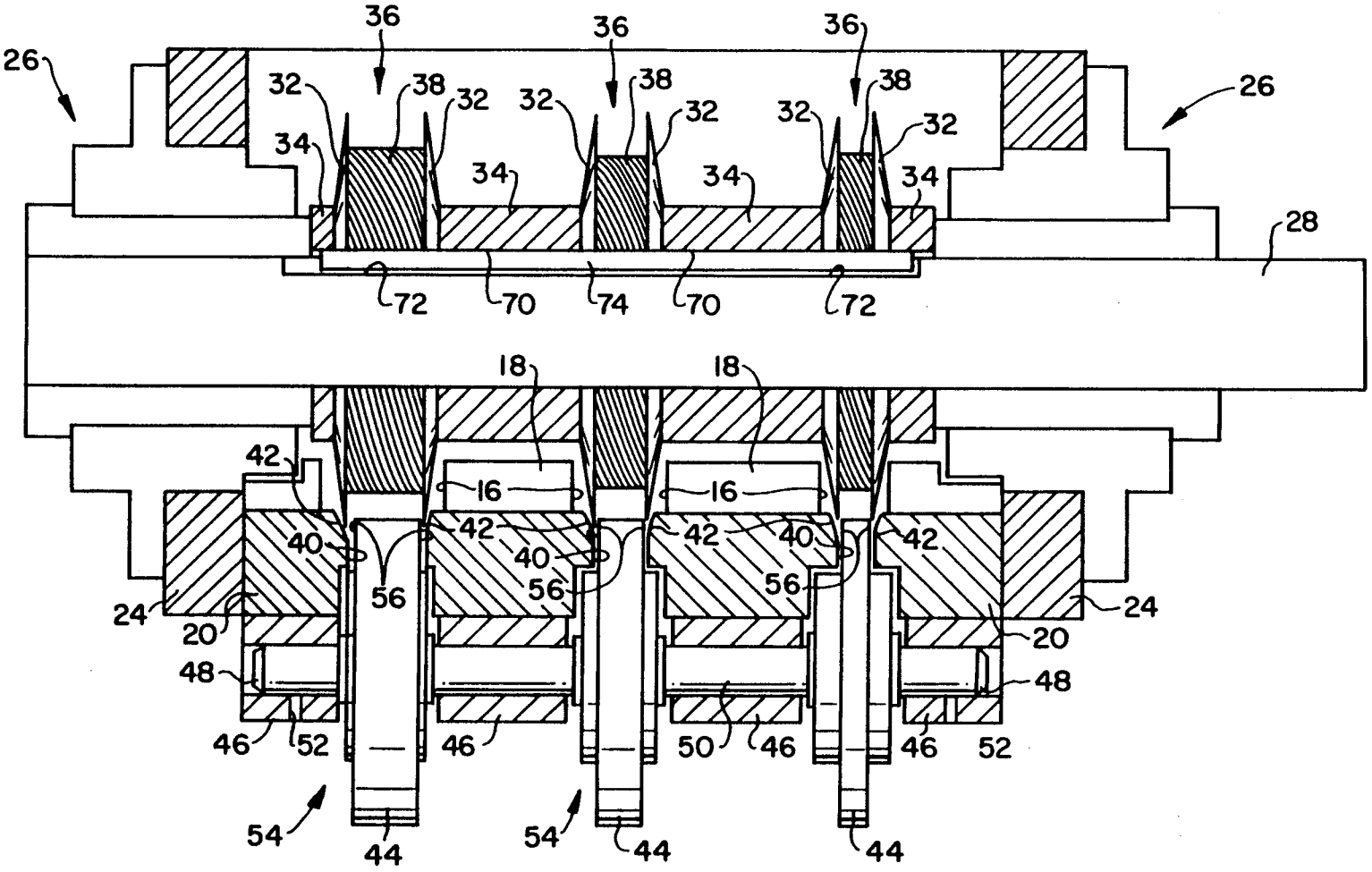
FIG. 5 is a view taken along line 5—5 of FIG. 4, partly in cross section and with some parts omitted for clarity.
Figure 6:
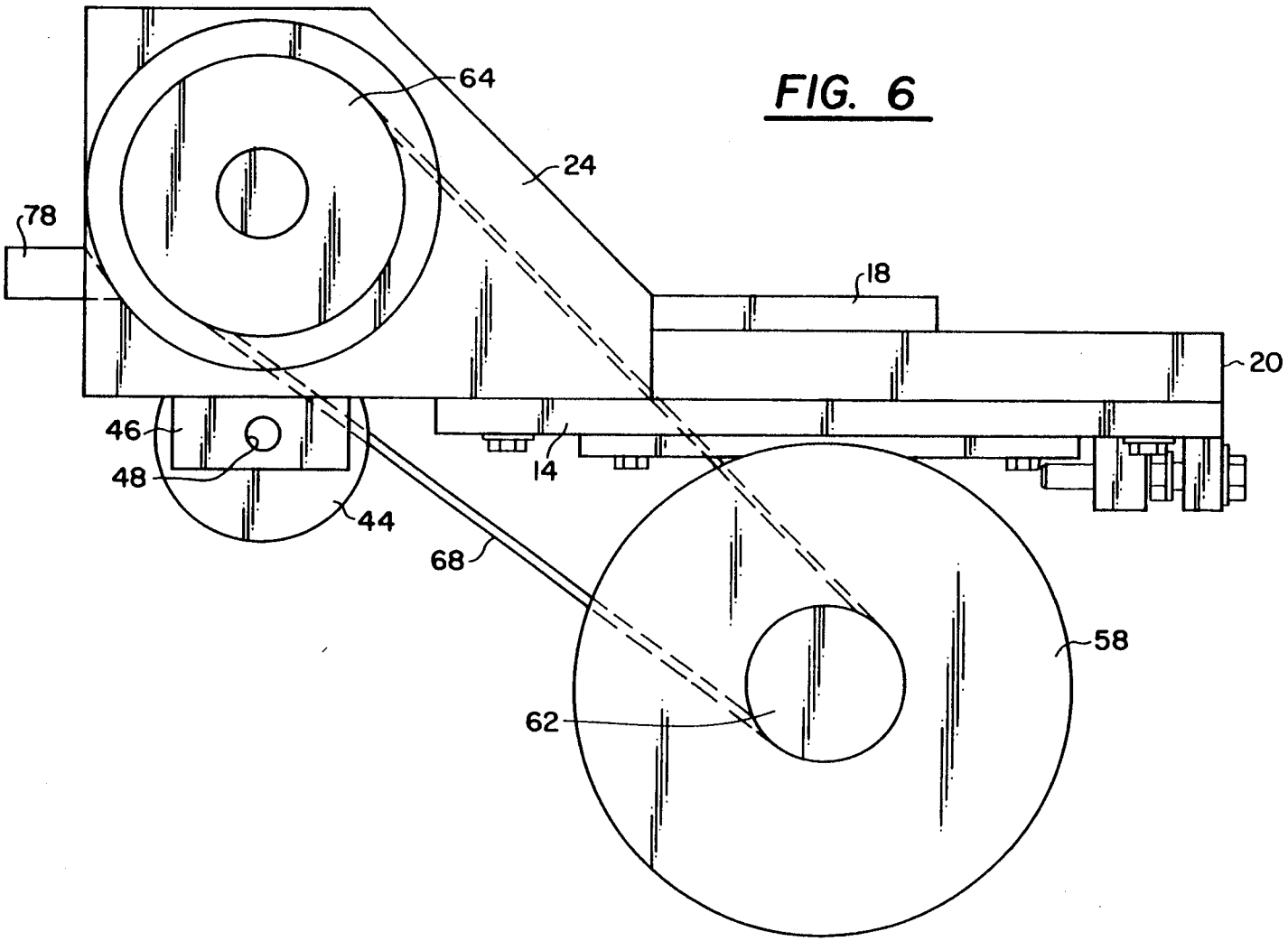
FIG. 6 is an elevational view of the vinyl trim salvage machine provided in accordance with the present invention taken from the bottom of FIG. 4.

As shown in particular in FIG. 5, the blades 32 of each pair are mounted to the shaft 28 and spaced apart from one another so that cutting edges thereof are disposed within the respective vinyl trim guide channel 16. More particularly, beneath each pair of cutting blades 32, a hole 40 is defined through the base plate 20 of the salvage machine 10, in the bottom of each vinyl trim guide channel 16. The longitudinal side edges of each opening are sloped downwardly and inwardly as shown in particular at 42 in FIG. 5. Furthermore, the blades 32 are mounted to the shaft 28 and the shaft is mounted to the side walls 24 of the cutter housing 22 so that the peripheral edges of the blades 32 of each pair extend into each of the vinyl trim guide channels 16 and partially into the openings 40 in the base plate so that the cutting edges of the blades are disposed in close relation to the inclined edges 42 of the openings 40. As will become more apparent below, the over insertion of the blades 32 ensures that the undesirable portions 106 of the vinyl trim 108 will be fully severed from the desirable central portion 104.

Rotary supports 44 are further mounted to the undersurface of the base plate 20 and extend upwardly through openings 40 of the base plate so as to support vinyl trim 108 from below the cutting blades 32. In the illustrated embodiment, a plurality of support blocks 46 are mounted to the undersurface of the base plate 20, each of which has a bore 48 defined therethrough for accommodating a support roller mounting shaft 50. The support roller mounting shaft is fixed with respect to the support blocks 46 by, for example, inserting one or more set screws (not shown) through suitable apertures 52 defined in the support blocks 46 and into engagement with the support roller mounting shaft 50. Support rollers 44 are rotatable mounted to the support shaft 50 via, for example, bearings 54 at spaced locations along the length thereof corresponding to the spacing of the openings 40 defined through the base plate 20.

The support rollers 44 are configured and dimensioned and mounted to the support shaft 50 so that, as shown in FIG. 5, the circumferential edges thereof are in opposed facing relation to the circumferential edge of the knurled blade spacers 36 mounted to the rotary cutter shaft 28. Furthermore, the support rollers 44 are mounted such that the circumferential edges thereof, which are directly below the spaced pairs of cutting blades, are in the plane of the bottom of each of the vinyl trim guide channels 16. As shown in FIG. 5, the downwardly and inwardly sloped surfaces 42 of the openings 40 are thus defined adjacent axial sides 56 of the support rollers 44 for receiving the blades 32 of a respective pair.

Figure 3:
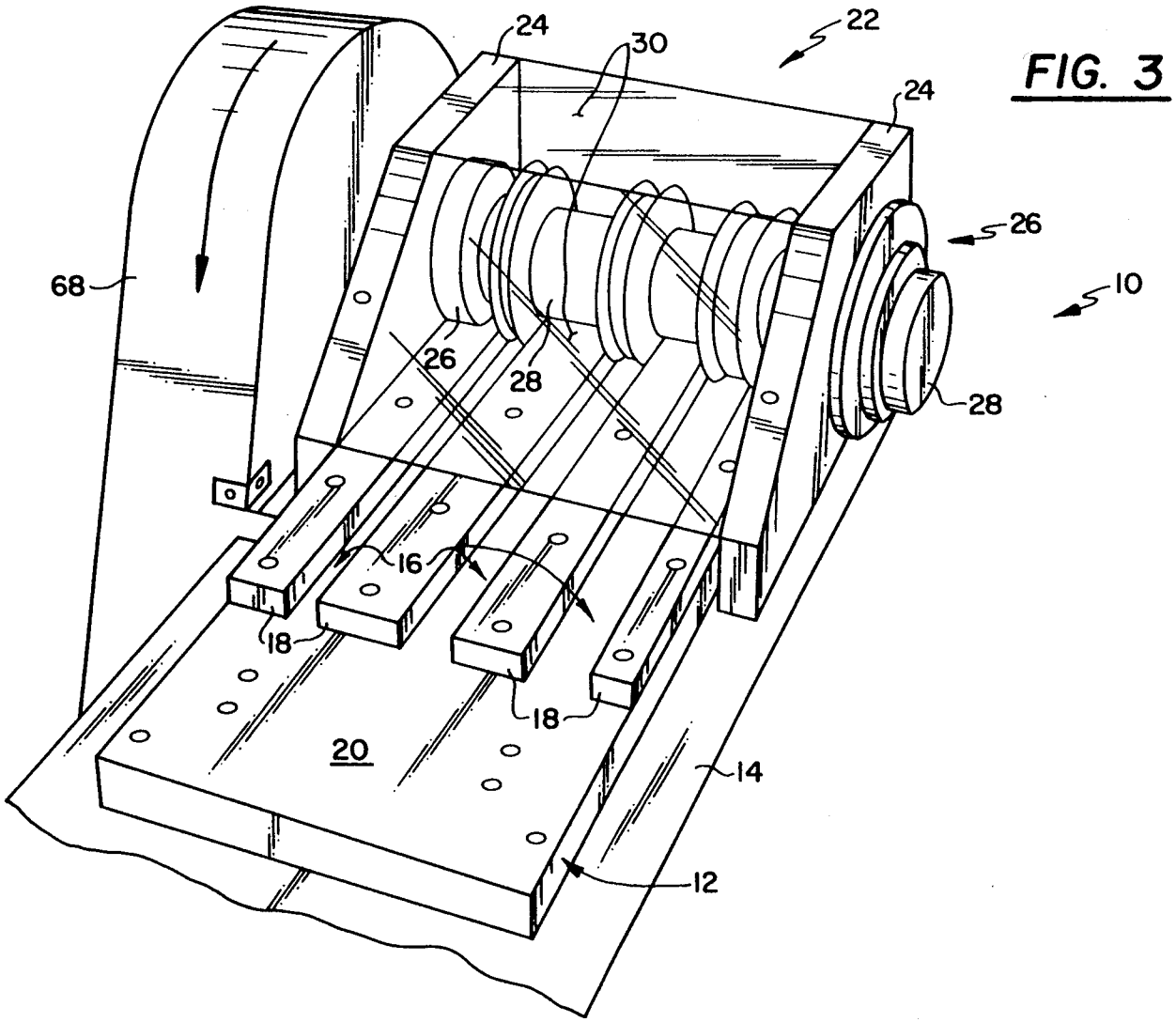
FIG. 3 is a perspective view from above of a vinyl trim salvage machine in accordance with the present invention.

The cutter shaft 28, as noted above, is rotatably mounted via bearings 26 to the side walls 24 of the cutter housing 22. The cutter shaft 28 itself can be rotated in any suitable manner. In the illustrated embodiment, a suitable motor 58 is mounted vertically below the base plate 20 and rotates a drive shaft 60. The drive shaft 60 has a suitable pulley structure 62 mounted thereto and the cutter shaft 28 has a corresponding pulley structure 64 mounted thereto. A belt 66 or the like is operatively engaged to the pulley 62 of drive shaft 60 and to the pulley 64 of cutter shaft 28 so that rotation of the motor drive shaft 60 will rotate the cutter shaft 28. As shown in FIG. 3, a housing 68 can be mounted in surrounding relation to the belt drive to protect the same from dirt and dust and to protect users of the machine.

The blades of each pair, the blade spacers and the spacers mounted between spaced pairs of blades can be fixedly mounted to the cutter shaft so as to rotate therewith in any known manner. In the illustrated embodiment, an elongated rectilinear channel 70 is defined through each of the blades 32 and each of the spacers 34, 36 to define a key way. Similarly, a rectangular groove 72 is defined in the cutter shaft 28. Key stock 74 is then inserted into the channel 70 and groove 72 to rotatably lock the blades 32 and respective spacers 34, 36 with respect to the cutter shaft 28. It is to be appreciated, however, that other means could be provided for fixedly mounting the blades to the shaft so as to rotate therewith.

As noted above, three pairs of cutter blades 32 are provided in accordance with the illustrated embodiment so that three different widths of vinyl trim 108 can be processed with the inventive salvage machine 10. It is to be understood, however, that where a single width of vinyl trim is typically processed, only a single pair of blades 32 need be provided. Similarly, additional pairs of blades can be provided to accommodate additional vinyl trim widths. The particular spacing of the blades 32 of a pair and the widths of the vinyl trim guide channels 16 of course depend upon the width of the vinyl trim 108 to be processed and the width of the central portion 104 to be salvaged.

When vinyl trim is to be salvaged using the machine provided in accordance with the present invention, a suitable vinyl trim guide channel is selected depending upon the width of the trim to be processed. Of course, as noted above, the width of the guide channel depends upon the total width of the vinyl trim whereas the spacing between blades of a pair is dependent upon the width of the recoverable vinyl central portion of the trim. Once a suitable guide channel and blade pair has been selected, the forward end of the vinyl trim 108 is advanced through the selected vinyl guide channel 16. As soon as the forward end of the vinyl trim 108 is nipped between the support roller 44 and the blade spacer 36, the blade spacer 36 will grip and longitudinally move the vinyl trim 108 as the support roller 44 freely rotates.

Figure 4:
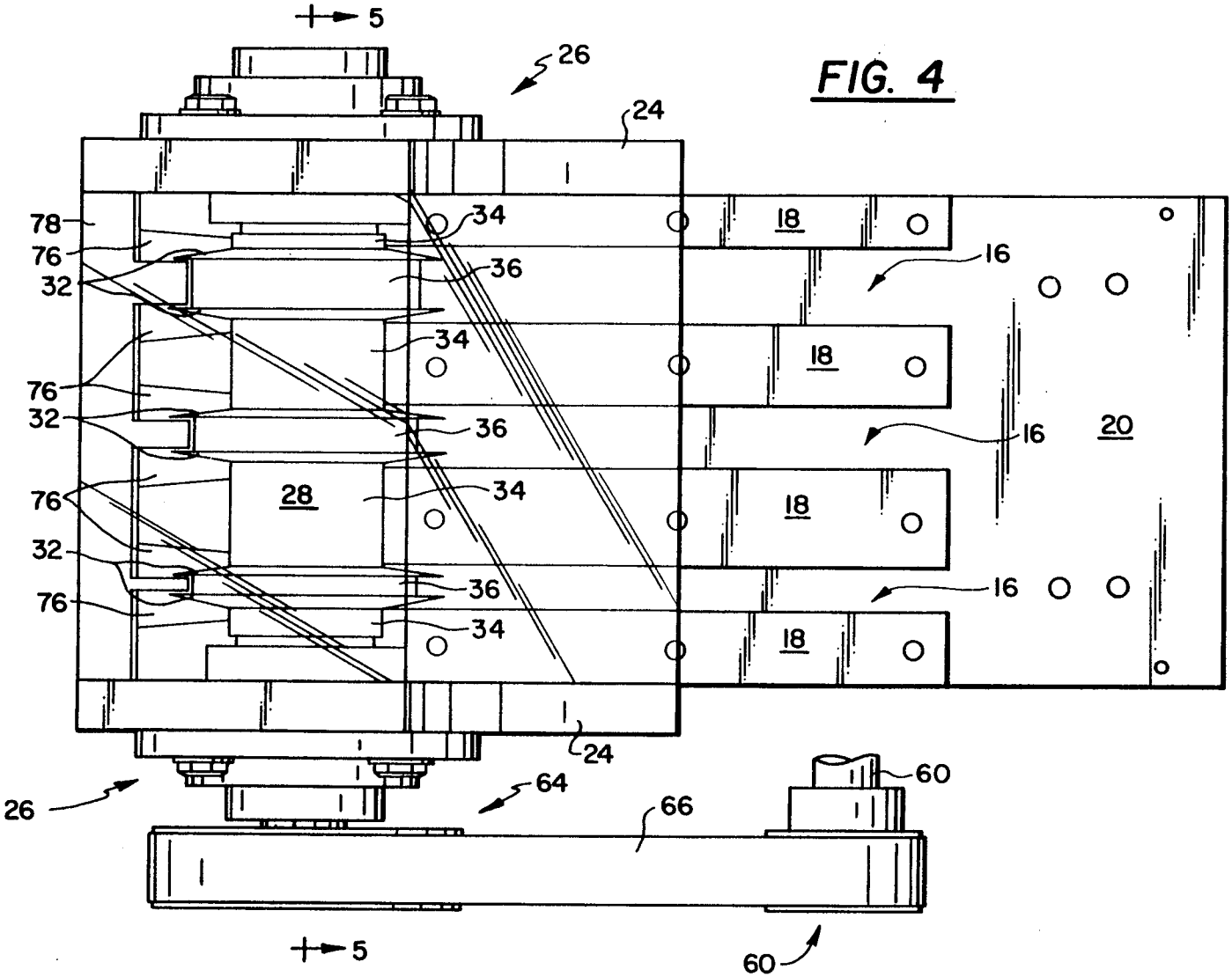
FIG. 4 is a top plan view of a machine provided in accordance with the present invention with some parts omitted for clarity.
Figure 7:
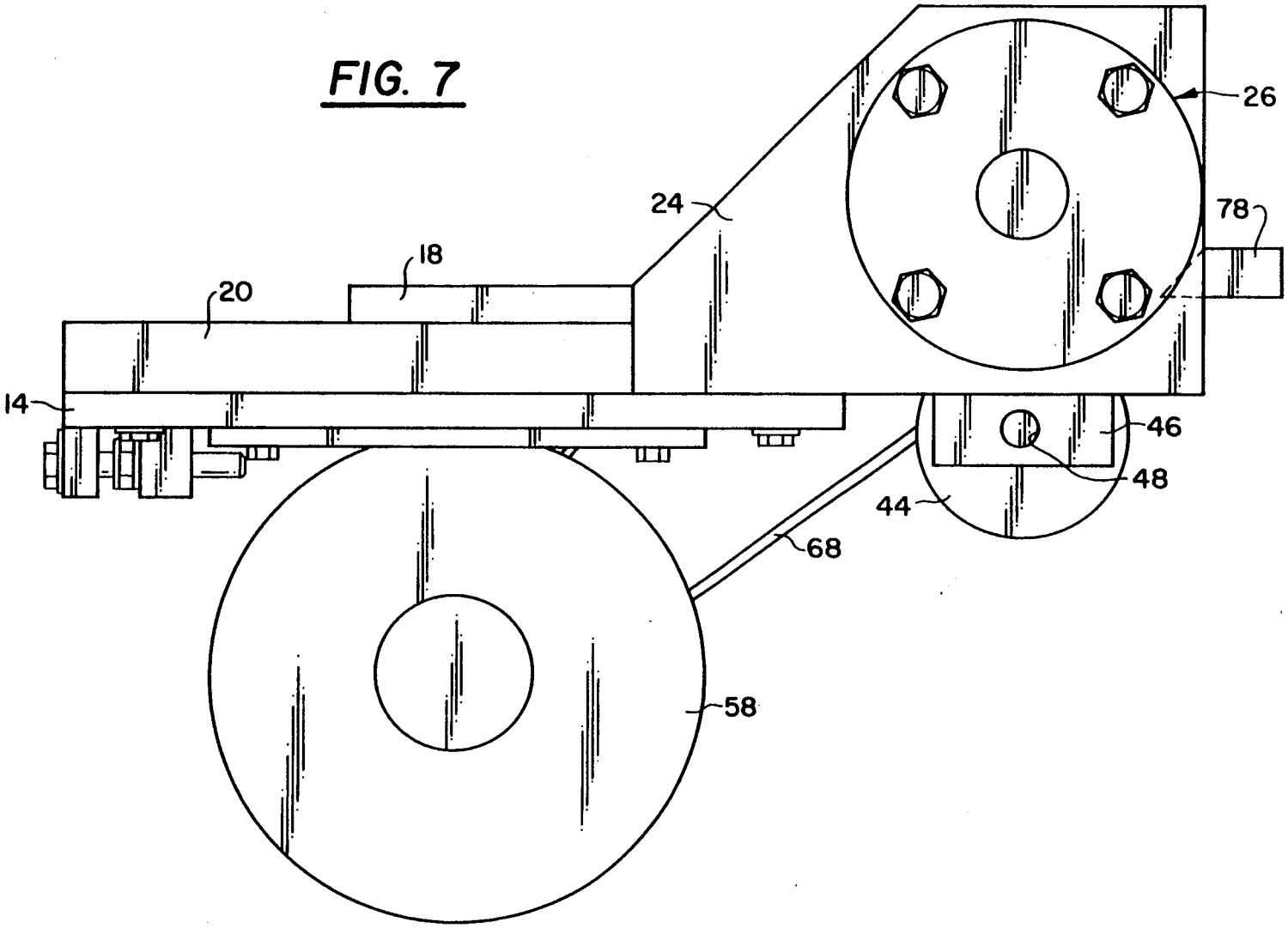
FIG. 7 is an elevational view taken from the top of FIG. 4.

As the blade spacer 36 grips and advances the vinyl trim 108, the blades 32 mounted on either side thereof simultaneously engage and cut the vinyl trim 108 at the side edges of the vinyl central portion 104 adjacent the metallic crimp 102 so as to cut the vinyl trim into three pieces, the two longitudinal metal edges 106 and the central vinyl trim piece 104. As shown in particular in FIG. 4, the vinyl trim guide channels 16 are preferably enlarged and most preferably gradually enlarged on the outlet side of the cutters as at 76 so as to accommodate the diverging portions of the severed vinyl trim 108. The salvaged vinyl mid-portion 104 is then reground and reused as needed and the metal crimped edges are discarded or otherwise further processed. Furthermore, as shown in particular in FIGS. 4 and 7, a stripper bar 78 is preferably mounted to housing 22 at the discharge end of machine 20 to keep the severed vinyl from feeding up and around spacers 36.

While the invention has been described in connection with what is presently considered to be the most practical and preferred embodiment, it is to be understood that the invention is not to be limited to the disclosed embodiment, but on the contrary is intended to cover various modifications and equivalent arrangements included within the spirit and scope of the appended claims.

What is claimed is:

1. A vinyl trim salvage machine comprising:

a substantially planar support base;

a cutter shaft having a longitudinal axis and first and second longitudinal ends;

a cutter housing having first and second side walls and an aperture defined through each said side wall for receiving a respective longitudinal end of said cutter shaft, said support base being fixedly secured to the walls of the housing so as to be irremovable without disassembly of the machine and extending at least from a vertical plane extending through the axis of the cutter shaft to a location upstream from said cutter shaft;

at least one cutter fixedly mounted to said cutter shaft, each said cutter including first and second spaced apart cutting edges;

at least one upwardly open guide channel defined on an upper surface of said planar support base by first and second guide channel walls which extend upwardly from the support base for receiving and guiding a workpiece to be severed by said cutter, each said cutter being mounted to said cutter shaft so that both cutting edges thereof extend into a respective guide channel so as to intersect a plane extending through a bottom surface of the channel;

means defining an opening through said support base vertically below each said cutting edge; and at least one support means disposed between said cutting edges so that an upper surface thereof lies in the plane of the bottom surface of the channel.

2. A vinyl trim salvage machine as in claim 1, wherein the support means comprises at least one support roller mounted to said support base so as to be rotatable with respect thereto, said support roller extending into said opening so that a tangent to a circumferential edge thereof is in the plane of the bottom surface of said guide channel.

3. A vinyl trim salvage machine as in claim 2, wherein longitudinal side edges of said opening are inclined so that said opening has a maximum width at said bottom surface of said guide channel and a minimum width spaced therefrom so as to define a cutting edge receiving channel on axial sides of said support roller.

4. A vinyl trim salvage machine as in claim 1, wherein said cutter comprises first and second substantially circular blade elements and a blade spacer mounted therebetween, said blade elements defining said cutting edges.

5. A vinyl trim salvage machine as in claim 4, wherein said blade spacer has a knurled circumferential surface.

6. A vinyl trim salvage machine as in claim 4, wherein said blade elements are scalloped blades.

7. A vinyl trim salvage machine as in claim 1, wherein at least two cutters are mounted to said cutter shaft.

8. A vinyl trim salvage machine as in claim 7, wherein three cutters are mounted to said cutter shaft.

9. A vinyl trim salvage machine as in claim 1, further comprising a bearing element mounted to each said side wall to rotatably mount each said longitudinal end of said cutter shaft to said side walls of said cutter housing.

10. A vinyl trim salvage machine as in claim 1, wherein said cutter housing further comprises a top wall, said top wall being at least partially transparent to allow observation of operation of the at least one cutter.

11. A vinyl trim salvage machine as in claim 1, further comprising means for rotating said cutter shaft comprising a motor having a drive shaft and means for operatively coupling said drive shaft of said motor to said longitudinal end of said cutter shaft.

12. A vinyl trim salvage machine as in claim 11, wherein said means for operatively coupling comprises pulley means mounted to said drive shaft, pulley means mounted to said cutter shaft, and a belt means mounted to and operatively coupling said pulley means of said drive shaft to said pulley means of said cutter shaft.

13. A vinyl trim salvage machine as in claim 1, wherein said guide channels are defined by a plurality of guide channel defining plates fixedly mounted to the upper surface of said support base.

14. A vinyl trim salvage machine as in claim 13, wherein three guide channels are defined on said upper surface of said support base.

15. A vinyl trim salvage machine as in claim 1, wherein each said guide channel has a substantially constant width along the length thereof on an upstream side of said respective cutter and wherein said guide channels have a gradually increasing width on a downstream side of said respective cutter.

* * * * *